US006893335B2

(12) United States Patent
MacKay

(10) Patent No.: US 6,893,335 B2
(45) Date of Patent: May 17, 2005

(54) MOUNTING DEVICE FOR ABRASIVE WHEELS

(76) Inventor: Joseph H. MacKay, P.O. Box 27497, San Diego, CA (US) 27497

( * ) Notice: Subject to any disclaimer, the term of this patent is extended or adjusted under 35 U.S.C. 154(b) by 0 days.

(21) Appl. No.: 10/490,122

(22) PCT Filed: Sep. 18, 2002

(86) PCT No.: PCT/US02/29590

§ 371 (c)(1),
(2), (4) Date: Jun. 17, 2004

(87) PCT Pub. No.: WO03/035324

PCT Pub. Date: May 1, 2003

(65) Prior Publication Data

US 2004/0219869 A1 Nov. 4, 2004

Related U.S. Application Data

(60) Provisional application No. 60/388,147, filed on May 17, 2002, and provisional application No. 60/323,288, filed on Sep. 19, 2001.

(51) Int. Cl.[7] ..... B24B 23/00

(52) U.S. Cl. ..... 451/359; 451/508; 451/510; 451/514

(58) Field of Search ..... 451/359, 508, 451/510, 514, 515

(56) References Cited

U.S. PATENT DOCUMENTS

| | | | | | |
|---|---|---|---|---|---|
| 302,952 | A | * | 8/1884 | Smith | 451/508 |
| 506,350 | A | * | 10/1893 | Towne | 451/508 |
| 1,896,738 | A | * | 2/1933 | Adometto | 451/508 |
| 2,671,994 | A | * | 3/1954 | Hickman | 451/508 |
| 4,878,316 | A | * | 11/1989 | MacKay, Jr. | 451/342 |
| 5,538,464 | A | * | 7/1996 | MacKay, Jr. | 451/342 |
| 5,733,183 | A | * | 3/1998 | Schierling et al. | 451/508 |
| 5,938,514 | A | * | 8/1999 | Amin et al. | 451/508 |
| 6,379,234 | B1 | * | 4/2002 | MacKay | 451/359 |
| 6,551,180 | B2 | * | 4/2003 | Braasch | 451/508 |
| 2004/0005851 | A1 | * | 1/2004 | MacKay | 451/359 |

* cited by examiner

*Primary Examiner*—M. Rachuba
(74) *Attorney, Agent, or Firm*—Fulbright & Jaworski L.L.P.

(57) ABSTRACT

A reusable mount for an abrasive device (14) including a nut (12) and a support unit (10). The nut (12) includes a threaded barrel (20) and a flange (22). The barrel extends through a central opening (15) in the abrasive device and the support unit it threadably attached by hand to the barrel to capture the abrasive device between the flange and the support unit. The assembled abrasive device and mount are then threadably secured to the spindle (70) of a power tool for use.

18 Claims, 4 Drawing Sheets

MOUNTING DEVICE FOR ABRASIVE WHEELS

CROSS-REFERENCE TO RELATED APPLICATION

The benefits of Provisional Application No. 60/323,288 files Sep. 19, 2001 by Joseph H. MacKay for MOUNTING DEVICE FOR ABRASIVE WHEELS and Provisional Application No. 60/388,147 filed May 17, 2002 by Joseph H. MacKay for IMPROVEMENT FOR MOUNTING DEVICE FOR ABRASIVE WHEELS is hereby claimed.

FIELD OF THE INVENTION

This invention relates generally to abrasive articles useful for grinding, cutting and finishing and more particularly to a reusable mount for attaching such articles to a power tool adapted for rotating the article during use.

BACKGROUND OF THE INVENTION

The use of rotatably driven abrasive articles for grinding, cutting and finishing work objects is widespread and very familiar in our industrial societies. Early on, such abrasive articles were affixed to portable rotary power tools such as air motors or the like by placing an internally threaded nut through a centrally located opening in the abrasive article. The nut included a hub portion which fitted into the bore so that a head or flange portion of the nut abutted the underside of the abrasive article. The nut is adapted to be mounted to the threaded spindle of the power tool. Typically a support flange is positioned on the spindle of the power tool between the abrasive article and an annular shoulder formed on the spindle to provide backing support for the abrasive article. Typically the support is made of a metal stamping that is configured to engage the backside of the abrasive article. The direction of rotation of the spindle when the rotary motor is energized is such that the nut will self thread onto the spindle until a tight frictional engagement is provided. Typically the abrasive article when it is spent is removed from the spindle by applying a wrench to the nut. The nut in the prior art conventional assemblies is not permanently affixed to the abrasive article, but rather is intended to be reused when a worn abrasive article is replaced. Also the support flange is not permanently affixed to the abrasive article and also is intended to be reused with new disks. Typical of such prior art abrasive finishing devices and the means of attachment to the power tool are shown in U.S. Pat. Nos. 489,149; 3,596,415; 1,998,919; 566,883; 507,223; 1,162,970; 791,159; 489,149 and 3,210,892.

With these earlier prior art devices, which included the flange and nut, it was very difficult to remove the spent finishing article because of the extreme forces applied to it during operation of the power tool. As above indicated, such removal required the utilization of a wrench or other tool which expended a large amount of time and effort on the part of the user.

Subsequently it became desirable to affix the mount permanently to the abrasive device so that the entire unit may be quickly and easily attached and detached from the drive shaft of the power motor and discarded along with the abrasive article when the abrasive article has been spent. In these types of devices it has become customary to either utilize an adhesive such as an epoxy resin or the like to attach the mounting hub to the abrasive article or alternatively to crimp a portion of the mounting hub to the abrasive article to retain it permanently in place upon the abrasive article and to secure the article rotationally. Various prior art patents showing such devices are U.S. Pat. Nos. 3,136,100; 415,371; 2,278,301; 3,081,584; 3,500,592; 3,800,483; 4,240,230; 4,541,205; 3,041,797; 3,879,178; 1,724,742; 3,912,411; 3,879,178; 3,960,516; 4,026,074; 4,054,425; 4,088,729; 4,322,920; 4,439,953; 4,449,329; 4,601,661; 791,791; 872,932; 2,567,782; 3,136,100; 3,210,892; 3,621,621; 4,924,634; 5,287,659 and 4,760,670. With these devices, where a portion of the mounting structure is permanently affixed to the abrasive article an additional cost is added to the abrasive article, because of the labor in attaching the mount and the discarding of the permanently attached mounting structure.

As a result of the experience in the industry utilizing abrasive devices, it became apparent that there was a need for a reusable mounting structure which will quickly and easily accept the abrasive article without being permanently attached in any fashion to the abrasive article and which at the same time will provide sufficient clamping to maintain the integrity of the abrasive article during operation while allowing easy removal of the abrasive article from the power tool once it has been spent without the necessity of utilizing tools. Such a device is shown in U.S. Pat. No. 6,379,234 which includes a support unit defining a bore with a resiliently deformable member disposed therein which grips the barrel of a retainer nut to hold the mount on the wheel for attachment to the power tool.

The foregoing devices work well for the purpose intended, however, it was discovered that a reusable mount for abrasive devices which could be more positively secured to the abrasive device was desirable. At the same time the abrasive device when spent must be easily removable by hand from the power tool and the mount.

SUMMARY OF THE INVENTION

A reusable quick change mount for use with abrasive devices which are adapted for rotation by a rotary power tool which mount includes a nut having a barrel with a flange extending radially outward from one end thereof with the barrel adapted to be received within the central opening of the abrasive device so that at least a portion of the flange engages the abrasive device with a portion of the barrel extending beyond the abrasive device. The external surface of the barrel is threaded. There is also included a support unit having a centrally disposed threaded bore which matingly engages the threaded outer surface of the barrel to thereby capture the abrasive device between the flange and the support unit. Threads are provided on the barrel that are adapted to matingly engage threads carried by the rotary power tool for rotation of the abrasive device during use. Once the nut and support unit are snugly secured to the abrasive device by hand there is substantially no relative movement between them during use.

DETAILED DESCRIPTION

The reusable quick change mount constructed in accordance with the principles of the present invention provides for vary rapid and easy attachment of an abrasive device such as a grinding wheel to a power tool. The mount is tightened snugly by hand on the abrasive device before it is rotationally secured to the power tool. Such tightening is sufficient to secure the abrasive device to the mount for use in cutting or finishing metallic workpieces. After the abrasive device has been spent, the mount of the present invention is constructed in such a manner that very quick and easy removal of the spent abrasive device can be accomplished after the mount and abrasive device is removed from the power tool simply by rotation of the mount components by hand as opposed to utilizing tools such as wrenches or the like to loosen the mount.

The reusable quick change mount of the present invention is usable upon a wide variety of abrasive devices such as grinding wheels, flap discs, cut-off wheels and the like and may be utilized upon such devices having very small to the largest diameters. The mount employs two components neither of which is permanently installed upon the abrasive device. Each of the components is durable and reusable with large quantities of abrasive devices. As a result, the cost of mounting hubs which are permanently installed in a non-removable fashion upon abrasive devices as well as the cost of installation thereof and the waste and pollution associated with the disposal of used abrasive devices containing such permanently installed mounting hubs thereon is totally eliminated.

The two components which form the reusable quick change mount of the present invention include a support unit which functions as a backing flange for the abrasive device during use and a threaded nut or retainer member which holds the abrasive device in place for use upon the power tool. The nut includes a barrel extending from a flange with the nut being inserted into the bore centrally disposed through the abrasive device in such a manner that a portion of the barrel projects through the abrasive device. The support unit has a threaded bore therethrough which threadably receives that part of the threaded barrel extending beyond the abrasive device and causing the abrasive device to be captured between the support unit and the nut flange while the assembly is being handled for quick and easy attachment to a power tool.

After use, typically when the abrasive device is spent, the user merely grips the abrasive device and turns it in the counter clockwise direction to quickly and easily remove the spent abrasive device along with the nut and support unit from the power tool after which the support unit and nut are disengaged simply by rotation to separate them and the abrasive device is discarded. The nut and support unit are then ready for reuse by being assembled to another abrasive device.

Figure 1:
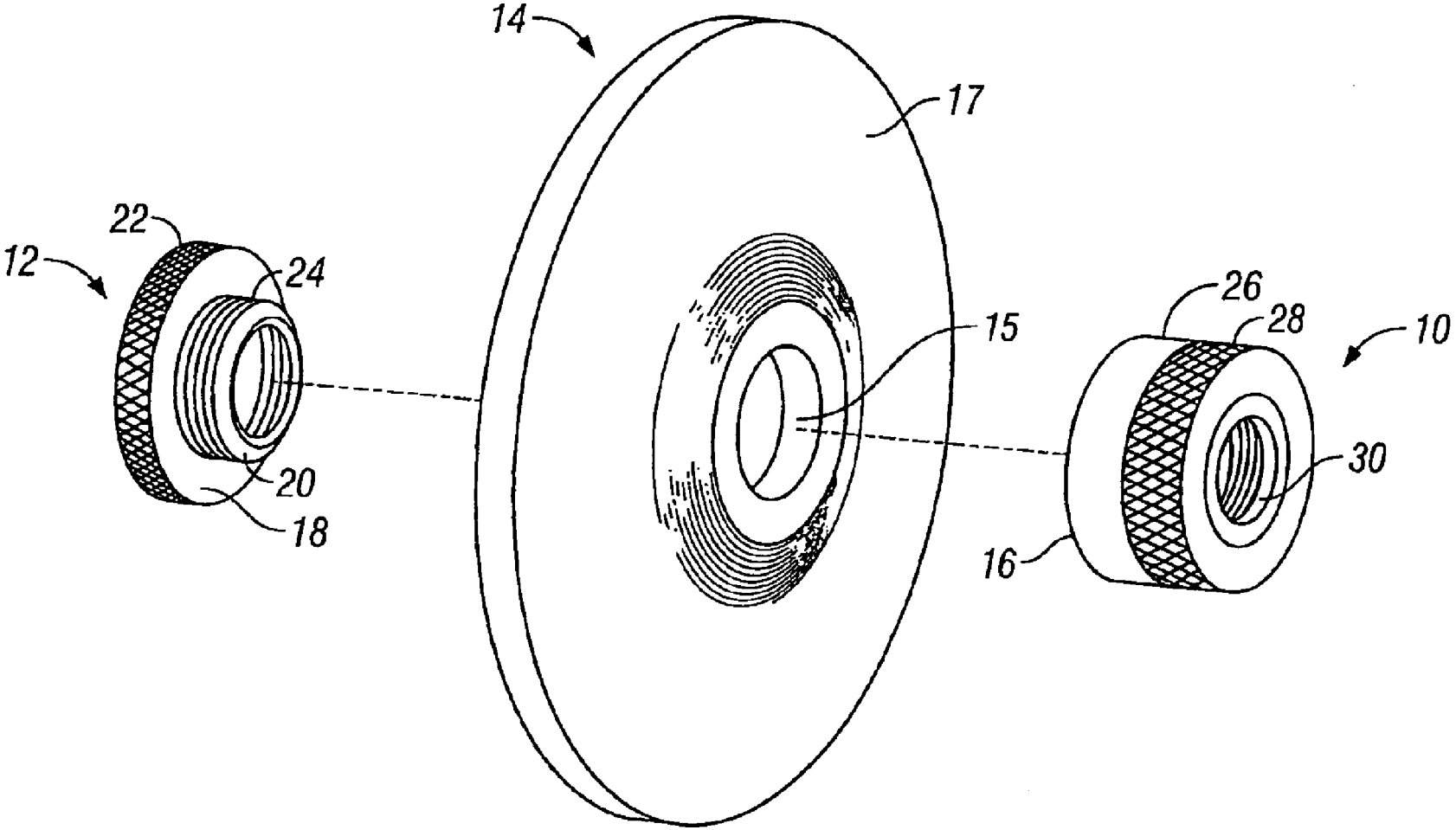
FIG. 1 is an exploded view in isometric form of the reusable quick change mount of the present invention just prior to assembly with a depressed center grinding wheel.
Figure 2:
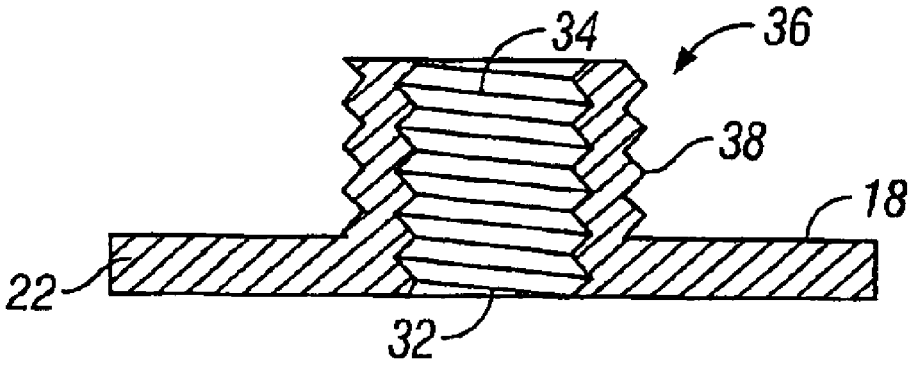
FIG. 2 is a cross-sectional view of the nut utilized as one of the components of the mount.
Figure 3:
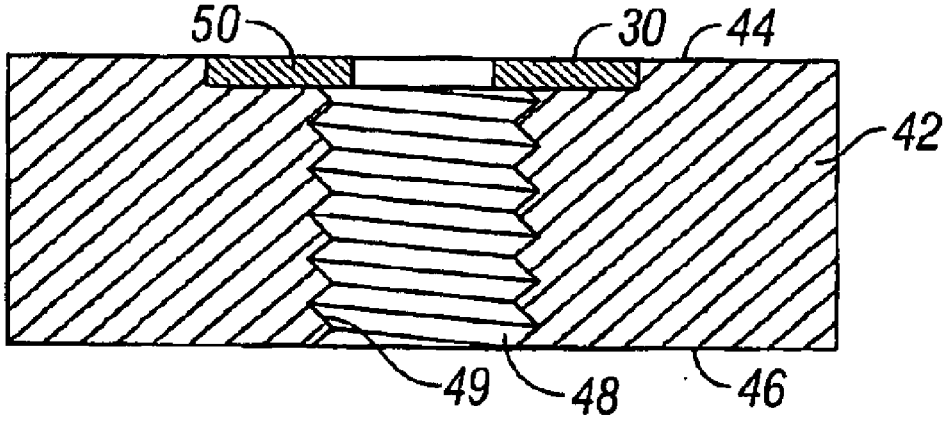
FIG. 3 is a cross-sectional view of the support unit which is the other component of the mount.

Referring now to the drawings and more particularly to FIGS. 1–3. The construction of a preferred embodiment of the reusable quick change mount of the present invention is illustrated. As is therein shown, the two components of the mount are a support unit or backing member 10 and a nut or retainer member 12. An abrasive finishing article such as a depressed center grinding wheel 14 having a centrally disposed opening 15 between the opposed surfaces 16 and 18 of the support unit 10 and the nut 12. The nut 12 includes a barrel 20 having a flange 22 extending outwardly from a first end 24 thereof The surface 18 is the upper surface of the flange 22 and when assembled with an abrasive device will contact that device. The nut 12 is formed preferably from a unitary metallic work piece. The support unit 10 includes a body 26 having an upper knurled ridge 28 which facilitates gripping and holding of the support unit 10 during installation thereof upon an abrasive member. A wear or bearing surface 30 is also provided on the support unit 10. The bearing surface 30 engages a shoulder which exists upon the drive member of a power tool which is assembled with the reusable quick change mount of the present invention.

As is more clearly seen in FIG. 2, the nut 12 defines a bore 32 extending through the barrel 20. The barrel 20 also includes an outer surface 36 which is also threaded as illustrated at 38. The bore 32 is threaded as illustrated at 34.

The support member 10 as seen in FIG. 3 is constructed from a metallic body 42 and includes a first surface 44 and a second surface 46. The metallic body 42 may be any material desired and preferably is machined steel which defines a bore 48 extending therethrough. The bore 48 defines threads as illustrated at 49. The threads 49 are adjusted to matingly engage the threads 38 on the barrel 20 of the nut 12. The bearing surface 30 may preferably comprise a washer like member of heat treated steel 50 which is secured to the first face 44 of the body 42. The face 44 is counter bored to provide a recess within which the washer 50 is seated. The surrounding material on the face 44 is then stamped or upset to permanently secure the washer 50 in place. The wear surface 30 provides a surface which will tolerate numerous uses of the support unit 10 with various abrasive devices. Alternatively the washer 50 in some circumstances may be constructed of a hard plastic material. As above pointed out, when the reusable quick change mount of the present invention is assembled upon an abrasive device, the barrel 20 of the nut 12 is inserted through the opening 15 of the abrasive device 14 with at least some of the threads 20 extending beyond the top surface 17 thereof. The support unit 10 is then assembled by threadably securing it on the threads 20 and snugly tightening it against the surface 17. Such tightening securely holds the nut and the support unit firmly together on opposite sides of the abrasive article which is trapped between the flange 22 and the surface 46 while the combination is threaded upon the threaded shaft of the power tool through utilization of the threads 34 on the nut 12.

Figure 4:
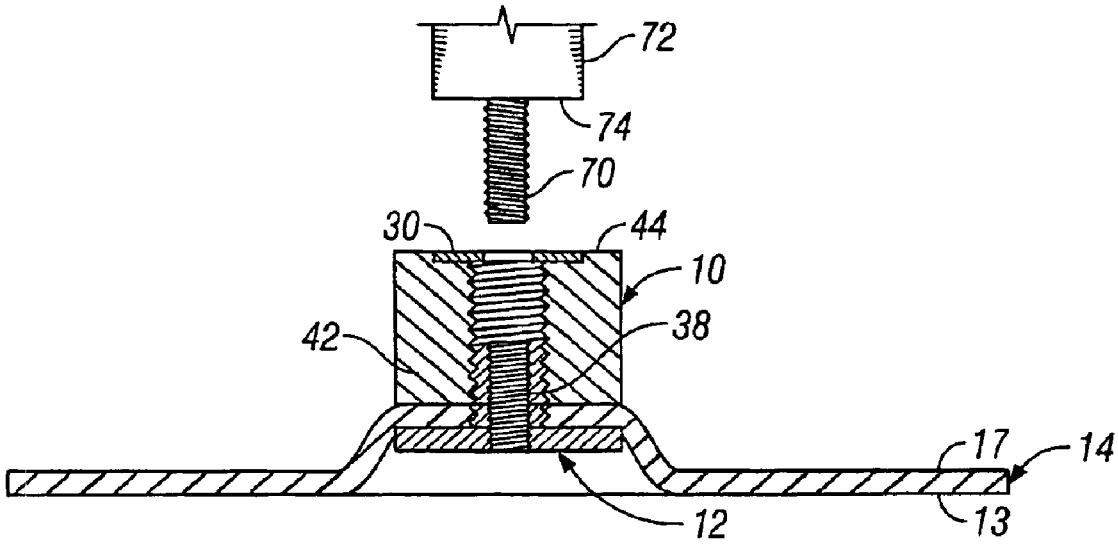
FIG. 4 is a cross-sectional view of the quick change mount of the present invention assembled upon a depressed center grinding wheel ready to be attached to a threaded drive member of a rotary power tool.

By reference now to FIG. 4, there is illustrated in partial cross-sectional view, the structure illustrated in FIG. 1 in assembled form ready for use. As is therein shown, the grinding wheel 14 having a first surface 13 and a second or top surface 17 has the barrel 20 of the nut 12 inserted through the opening 15 therein. As is illustrated, a portion of the threads 38 on the outer surface of the barrel 20 protrude through the opening 15 and extend beyond the surface 17. The support unit 10 is then secured to the abrasive wheel 14 by mating the threads 49 formed in the bore 48 with the threads 38. The support unit is hand tightened through the facility of the knurling 28 on the body 26 so that the wheel 14 is snugly trapped between the surface 18 of the flange 22 and the surface 46 of the support unit 10. Thereafter the assembled wheel and reusable mount are brought into engagement with the threaded shaft or spindle of a power tool. As is illustrated, the threaded shaft 70 of a power tool (not shown) is threadably engaged with the threads 34 in the bore 32 of the nut 12. A shoulder 74 formed on the power tool shaft 72 engages the wear or bearing surface disposed upon the first face 44 of the body 42 of the support unit 10. It should be understood that the shaft 70 may be part of a powertool or alternatively be a shaft that is received within a collet or chuck of a powertool. The diameter of the body 42 of the support unit 10 and the flange 22 of the nut 12 are substantially the same and thus the surface 46 of the support unit engaging the surface 17 of the wheel 14 provides adequate support for the wheel during use except when very large (5 inches in diameter or larger) wheels are used.

It should be recognized that when the grinding wheel 14 assembled with the reusable mount of the present invention, as shown in FIG. 4, is placed in use by the rotary power tool there will be very little relative movement between the nut 12 and the support unit 10. Such results because the engagement of the threads 38 on the nut barrel and the threads 49 on the support unit lock these two elements together and prevent vertical movement there between (as viewed in FIG. 4) even though an upward force is applied to the nut 12 by the threaded engagement with the threaded shaft 70 on the power tool. The force is absorbed by the bearing surface 30 and the body 42 of the support unit 10. In the event that wheel 14 rotates when grinding starts, the nut 12 may rotate slightly to lock the wheel in place. At most, such rotation will be only a few degrees. When use is completed and the grinding wheel 14 is to be discarded, it may be easily removed from the threaded shaft 70 of the power tool 72 simply by gripping the remaining portion of the grinding wheel 14 and turning it in a counter clockwise direction without the use of tools of any type. The construction of the reusable quick change mount of the present invention provides immediate and easy release from the power tool 72 whereupon the nut and support unit may be threadably separated for reuse and the spent grinding wheel 14 discarded.

Figure 5:
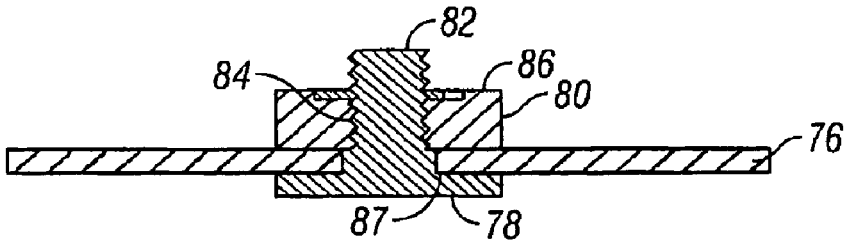
FIG. 5 is a cross-sectional view of an alternative embodiment of the reusable mount of the present invention installed on a cut off wheel.

By reference now to FIG. 5, there is shown in cross sectional view a cut-off wheel 76 assembled between a nut 78 and a support unit 80 in the manner above described by inserting the threaded barrel 82 of the nut 78 through the opening 84 in the cut-off wheel and threadably attaching the support unit 80 thereto to capture the cut-off wheel 76 between the support unit 80 and the nut 78. The barrel has an enlarged diameter portion 87 at its lower end adapted to snugly be received within the opening in the cut-off wheel. An internally threaded spindle on a cut-off tool (not shown) threadably engages the thread on the outer surface of the barrel 82 of the nut 78. The end of the spindle will bear against the surface 86 on the top of the support unit 80.

Figure 6:
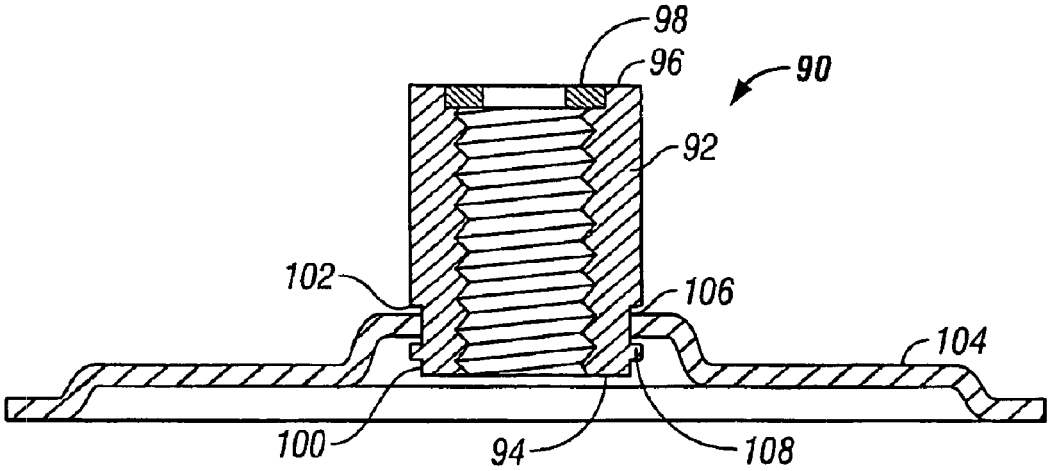
FIG. 6 is a cross-sectional view of an alternative embodiment of a support unit of the present invention.

Referring now more particularly to FIG. 6, there is illustrated in cross section a support unit for use with large grinding wheels or other abrasive devices. Such devices require more support than can be provided by the support unit above shown and described. As is illustrated in FIG. 6, the support unit 90 includes a body 92 having first and second ends 94 and 96 respectively. A bearing 98 is inserted in the end 96. The body 92 is turned down or milled to reduce its diameter as shown at 100 to provide a shoulder 102. A flange 104 having a central opening 106 is disposed abutting the shoulder 102. The end 94 of the body is then stamped or swaged to form a bead or ring 108 of metal to loosely secure the flange 104 to the body 92 of the support unit 90. Such an arrangement reduces friction when the body 92 of the support unit 90 is threaded secured to the threaded barrel of a nut to secure the reusable mount to an abrasive device. That is, when the flange 104 contacts the abrasive device the body 92 can continue to rotate without rotation of the flange.

Figure 7:
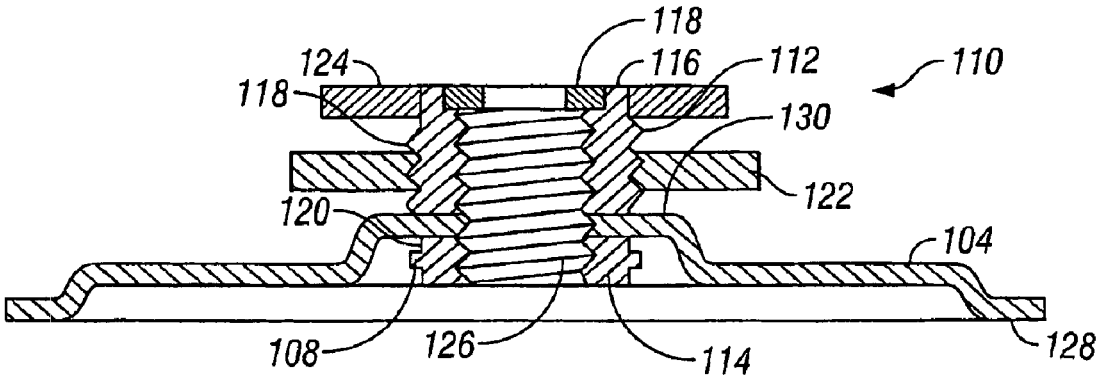
FIG. 7 is a cross-sectional view of a further alternative embodiment of a support unit of the present invention.

Referring now more particularly to FIG. 7 there is illustrated in cross-section an alternative embodiment of a support unit also for use with large grinding wheels or other abrasive devices. It has been found that with the depressed center grinding wheels 5 inches in diameter or larger, that there may be large variations in the height of the top of the depressed center wheel relative to the surface 17 of the wheel from manufacturer to manufacturer. Under some circumstances, the height of the top of the depressed center wheel is such that when the structure as used in FIG. 6 is utilized, the bottom surface of the flange will contact the back of the wheel prior to the surface 94 of the body 92 of the support unit contacting the top of the depressed center. When such occurs then under extreme use, there is a tendency for the depressed center wheel to turn in the mount. Although this does not create any particular problem insofar as safety is concerned, it is not a desirable situation. It therefore was found to become necessary to provide an adjustable height contact flange and such is provided in the structure illustrated in FIG. 7. As is therein shown, a support unit 110 includes a body 112 having a first surface 114 and a second surface 116. The bearing surface 118 is provided in the manner as above described. A stop ring 124 is positioned over the outside of the body 112 immediately proximate the upper surface 116. After the stop ring 124 is thus positioned, the top surface 116 is upset or staked to rigidly and non-detachably affix the stop ring 124 to the body 112. As is illustrated in FIG. 7, the external surface of the body 112 is provided with threads 118 extending from a point immediately below the stop ring 124 to a point 120 intermediate the stop ring 124 and the bottom surface 114. A base ring 122 is threadably attached to the threads 118. As was described previously with regard to FIG. 6, the flange 104 is positioned upon the outer surface of the body 112 and is then secured in place by staking to provide the bead or ring 108.

It should now be recognized by those skilled in the art that when a depressed center grinding wheel is assembled in place through the utilization of a nut being inserted through the opening therein and then being secured to the support member 110 by way of the threads 126 disposed internally thereof the surface 128 of the flange 104 will engage the back of the depressed center wheel causing the flange to move upwardly as viewed in FIG. 7 until the surface 114 of the body 112 engages the top of the depressed center wheel. When such occurs, the base ring 122 is then rotated downwardly until it engages the top surface 130 of the flange 104 immediately adjacent the outer surface of the body 112. The base ring 122 is then secured snugly by hand thus, clamping the abrasive grinding wheel between the support unit and the flange on the nut as above described.

As above described, the abrasive finishing wheel along with the mount is then secured upon the spindle or arbor of the power tool for use in the traditional manner. When use is completed, the user may grasp the wheel and remove the unit along with the mount from the power tool after which the base ring 122 is loosened by turning the same in a counter clockwise direction allowing the wheel to be removed and discarded while retaining the nut and support unit 110 for future use.

There has thus been disclosed a reusable a reusable quick change mount for use with abrasive devices which may be quickly and easily assembled on the abrasive device and easily and quickly removed when the device is to be discarded after use, after which, the mount may be reused with yet an additional or different abrasive device.

What is claimed is:

1. A reusable quick change mount for use with abrasive devices (14) having first (13) and second (17) surfaces and having a central opening (15) therethrough and adapted for rotation by a rotary power tool carrying threads (70), said mount comprising:

(a) a nut (12) having a barrel (20) carrying threads formatting with the threads carried by said power tool and having an outer surface (36), said barrel having first (24) and second ends;

(b) a first flange (22) extending radially outward at said first end of said barrel;

(c) said barrel being adapted to be received in said central opening of said abrasive device with a portion of said flange engaging said first surface thereof and a portion of said barrel including said second end extending beyond said second surface thereof;

(d) said outer surface of said barrel being threaded (38) over at least that portion extending beyond said second surface;

(e) a support unit (10) having a body (42) defining a first bore (48) centrally disposed therethrough, said first bore having threads (49) for mating with the threads on said outer surface of said barrel; and (f) said threads on said outer surface of said barrel and in said first bore, when engaged, operate to capture said abrasive device between said first flange and said support unit and operatively clamp said abrasive device for rotation by said power tool, the position of said support unit with respect to said nut, after assembly by hand on said abrasive device, remaining substantially unchanged during use thereby enabling removal of said support unit from said nut by hand after use to replace said abrasive device.

2. A reusable quick change mount as defined in claim 1 wherein said support unit body includes first (44) and second (46) faces, said first face being disposed away from said second surface of said abrasive device when assembled thereon, said first face further including a bearing surface (30) surrounding said first bore for engaging said power tool.

3. A reusable quick change mount as defined in claim 2 wherein said bearing surface on said first face is a heat treated steel material.

4. A reusable quick change mount as defined in claim 2 wherein said bearing surface is a hard plastic material.

5. A reusable quick change mount as defined in claim 2 wherein said bearing surface is a washer shaped material secured to said support unit.

6. A reusable quick change mount as defined in claim 1 wherein said nut defines a second bore (32) centrally disposed therethrough, said second bore carrying said threads (34) disposed on said barrel.

7. A reusable quick change mount as defined in claim 6 wherein said nut and first flange are formed from a unitary member.

8. A reusable quick change mount for use with abrasive devices (14) having first (13) and second (17) surfaces and having a central opening (15) therethrough and adapted for rotation by a rotary power tool carrying threads (70), said mount comprising:

(a) a nut (12) having a barrel (20) having an outer threaded surface (36) and defining a first threaded bore (32) centrally disposed therethrough, said barrel having first (24) and second ends, said threads in said first bore mating with the threads carried by said power tool when said abrasive device with said quick change mount assembled thereon is mounted upon said power tool;

(b) a first flange (22) extending radially outward at said first end of said barrel;

(c) said barrel being adapted to be received in said central opening of said abrasive device with a portion of said first flange engaging said first surface thereof and a portion of said barrel including said second and extending beyond said second surface thereof;

(d) a support unit (10) having a body (42) having first (44) and second (46) faces, said body defining a first threaded bore (48) centrally disposed therethrough, said first threaded bore (48) matingly engaging said threaded outer surface of said barrel;

(e) said threads, when matingly engaged, and when said abrasive device is being used, function to operatively clamp said abrasive device between said first flange and said second face of said support unit, the position of said support unit with respect to said nut, after assembly by hand on said abrasive device, remaining substantially unchanged during use thereby enabling removal of said support unit from said nut by hand after use to replace said abrasive device.

9. A reusable quick change mount as defined in claim 8 wherein said support unit first face being disposed away from said second surface of said abrasive device when assembled thereon, said first face further including a bearing surface (30) surrounding said first for engaging said power tool.

10. A reusable quick change mount as defined in claim 9 wherein said bearing surface on said first face is a heat treated steel material.

11. A reusable quick change mount as defined in claim 9 wherein said bearing surface is a hard plastic material.

12. A reusable quick change mount as defined in claim 9 wherein said bearing surface is a washer shaped material secured to said support unit.

13. A reusable quick change mount as defined in claim 8 which further includes a second flange (104) extending outwardly from said support unit adjacent said second surface thereof for engaging said second surface of said abrasive device.

14. A reusable quick change mount as defined in claim 13 wherein said second flange is rotational with respect to said support unit body.

15. A reusable quick change mount as defined in claim 14 wherein said support unit includes an outer threaded surface (118) and a base ring (122) threadably supported thereon.

16. A reusable quick change mount as defined in claim 15 wherein the threads on the outer surface intermediate said first and second faces such that said second flange is vertically movable with respect to said support unit body.

17. A reusable quick change mount as defined in claim 16 which further includes a stop ring (124) extending outwardly from said body adjacent said first face.

18. A reusable quick change mount as defined in claim 17 wherein said stop ring is seated onto said threaded outer surface of said body and then non-detachably secured thereto.

* * * * *